United States Patent [19]

Porenski et al.

[11] Patent Number: 4,527,570

[45] Date of Patent: Jul. 9, 1985

[54] DEVICE FOR MANUFACTURING A MOUTHPIECE AND ATTACHING MOUTHPIECES TO CIGARETTE TOBACCO COLUMNS

[75] Inventors: Harry S. Porenski; James W. Sullivan, both of Louisville, Ky.

[73] Assignee: Brown & Williamson Tobacco Corporation, Louisville, Ky.

[21] Appl. No.: 541,171

[22] Filed: Oct. 12, 1983

[51] Int. Cl.[3] ..... A24C 5/47; A24C 5/52

[52] U.S. Cl. ..... 131/94; 131/95

[58] Field of Search ..... 131/94, 95

[56] References Cited

U.S. PATENT DOCUMENTS

| | | | |
|---|---|---|---|
| 3,526,233 | 9/1970 | McArthur | 131/94 |
| 3,527,234 | 9/1970 | Hinzmann | 131/94 |
| 4,020,852 | 5/1977 | Baker | 131/94 |

*Primary Examiner*—V. Millin

*Attorney, Agent, or Firm*—Charles G. Lamb

[57] ABSTRACT

A device for attaching two axially aligned cigarette tobacco columns to an intermediately disposed double length rigid mouthpiece, hereinafter referred to as a cigarette group, by wrapping a sheet of tipping material around the double length rigid mouthpiece and a portion of each tobacco column adjacent to each end of the double length mouthpiece. The device comprises a stationary rolling block located in spaced relationship to the periphery of a cigarette group feed drum. The feed drum carries a plurality of cigarette groups at spaced apart intervals on its' periphery with a sheet of tipping material adhesively attached at the leading edge thereof to each of the cigarette groups. As a cigarette group passes beneath the rolling block, the cigarette group is caused to roll in a counter direction to the rotational direction of the feed drum along the peripheral surface of the feed drum causing the sheet of tipping material to wrap around the double length rigid mouthpiece and portion of each tobacco column immediately adjacent to the double length mouthpiece.

16 Claims, 6 Drawing Figures

DEVICE FOR MANUFACTURING A MOUTHPIECE AND ATTACHING MOUTHPIECES TO CIGARETTE TOBACCO COLUMNS

BACKGROUND OF THE INVENTION

1. Field of the Invention

The present invention relates to the manufacture of cigarettes having a rigid mouthpiece attached at one end, and more particularly to a device for attaching two coaxially aligned cigarette tobacco columns to an intermediately disposed double length rigid mouthpiece as an interim step in the manufacture of a finished cigarette having a rigid mouthpiece attached at one end.

2. Description of the Present Art

It is known to attach two coaxially aligned cigarette tobacco columns to an intermediate double length filter rod by wrapping a tipping material about the double length filter rod and a portion of each tobacco column adjacent to the filter rod to produce a filter rod-tobacco column group. After the tobacco columns are thus attached to the double length filter rod, the double length filter rod is cut at the transverse centerline thereby providing two individual filtered cigarettes.

Various devices are known for performing the task described above. Examples of heretofore known devices are shown in U.S. Pat. No. 2,166,486 issued on July 18, 1939, to W. F. M. Edwards; U.S. Pat. No. 2,194,378 issued on Mar. 19, 1940, to Adolf Bernd; U.S. Pat. No. 2,786,472 issued on Mar. 26, 1957, to Richard Gruezburg; U.S. Pat. No. 2,809,640 issued on Oct. 15, 1957, to Henry A. Oldenkamp; and U.S. Pat. No. 3,001,528 issued on Sept. 26, 1961, to B. Schubert.

Generally, the heretofore known devices frictionally engage the periphery of the intermediately disposed filter rod and tobacco columns causing the filter rod-tobacco column group to roll, thus, wrapping the tipping material around the double length filter rod and portions of the tobacco columns adjacent to the ends of the double length filter rod.

SUMMARY OF THE INVENTION

While the heretofore known devices of the type described above may be satisfactory to connect filter rods to tobacco columns, a two-fold problem arises when attaching a rigid mouthpiece to the tobacco columns. Filter rods are fabricated of relatively soft, resilient fibrous or foamed materials such as, for example, cellulose acetate which presents a peripheral surface of relatively high coefficient of friction to the contact surface of the rolling device. However, rigid mouthpieces are typically fabricated of a smooth, hard plastic material which has a relatively low coefficient of friction. For this reason, when using a heretofore known rolling device to roll the double length mouthpiece-tobacco column group, it occurs that the double length mouthpiece-tobacco column group will slide rather than roll through the rolling device and the tipping material will, therefore, not be wrapped around the rigid double length mouthpiece and portions of the tobacco columns adjacent to the ends of the mouthpiece. Increasing the normally directed force exerted by the rolling device against the double length mouthpiece will increase the functional force between the rolling device and mouthpiece, however, the rigid material of the mouthpiece will crack if the normal force exerted against it is too great.

The present invention recognizes this dilemna, and provides a solution thereto.

More particularly, in one embodiment the present invention provides a device for applying two paper rings around the circumference of a double length cigarette mouthpiece spaced apart from each other to opposite longitudinal sides of the transverse centerline of the double length mouthpiece, comprising a rotatable drum at least as wide as the length of the double length mouthpiece, the rotatable drum having a plurality of double length mouthpiece receiving notches formed in its periphery at spaced apart intervals therearound, the notches being oriented with their longitudinal axes substantially parallel to the axis of revolution of the drum, and a stationary wrapping block having an arcuate contact surface concavely facing the periphery of the drum, the arcuate contact surface of the wrapper block corresponding to the curvature of the peripheral surface of the drum and being spaced from the peripheral surface of the drum by a preselected distance less than the diameter of the double length mouthpiece, and two spaced apart contact zones spaced apart to opposite sides of the longitudinal centerline of the wrapping block adapted to contact longitudinally spaced apart portions of the double length mouthpiece, the contact zones being of a relatively high coefficient of friction with the mouthpiece.

In a further embodiment the present invention provides a device for attaching two cylindrical tobacco columns to an intermediately disposed double length mouthpiece by wrapping a sheet of tipping material around the double length mouthpiece and a portion of each tobacco column immediately adjacent to each end of the double length mouthpiece to form a cigarette group comprising a rotatable drum at least as wide as the combined lengths of the two tobacco columns and intermediate double length mouthpiece, the rotatable drum having a plurality of cigarette group receiving notches formed in its periphery at spaced apart intervals therearound, the notches being oriented with their longitudinal axes substantially parallel to the axes of rotation of the drum, and a stationary rolling block having an arcuate contact surface concavely facing the periphery of the drum, the arcuate contact surface of the rolling block corresponding to the curvature of the peripheral surface of the drum and being spaced from the peripheral surface of the drum by a preselected distance less than the diameter of the double length mouthpiece, at least the middle zone of the contact surface being adapted to contact the intermediately disposed double length mouthpiece of the cigarette group on the peripheral surface of the drum between adjacent notches formed in the drum being of relatively soft, resilient material having a relatively high coefficient of friction with the mouthpiece.

BRIEF DESCRIPTION OF THE DRAWINGS

A more clear understanding of the present invention will be had upon reference to the following discussion in conjunction with the accompanying drawings in which like numbers refer to like parts through the views and wherein.

DETAILED DESCRIPTION OF THE PREFERRED EMBODIMENTS

Figure 1:
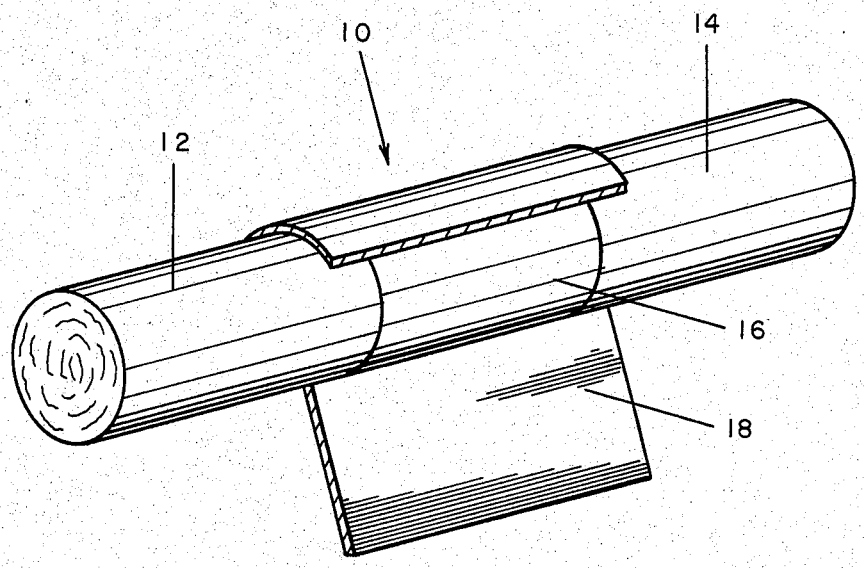
FIG. 1 is typical of a cigarette group produced by the present invention with the tipping material partially unwrapped to more clearly show details.

First, with reference to FIG. 1, there is shown a cigarette group, generally denoted as the number 10, consisting of two axially aligned tobacco columns 12 and 14 and an intermediate double length rigid mouthpiece 16. In the manufacture of cigarettes, the tobacco columns 12 and 14 are attached to opposite ends of the intermediate double length rigid mouthpiece 16 by a sheet of tipping material 18 which is wrapped around the double length rigid mouthpiece 16 and a portion of each tobacco column 12 and 14 adjacent to each end of the mouthpiece and adhesively attached thereto by rolling pressure. For example, if the double length mouthpiece 16 is 52 mm long, the tipping material 18 would be 57 mm wide so that it overlaps the end of each tobacco column 12 and 14 adjacent to the mouthpiece 16 by approximately 2½ mm. After the tobacco columns 12 and 14 have been attached to the double length mouthpiece 16 producing a cigarette group 10, the double length mouthpiece 16 is severed at its transverse centerline which results in two individual cigarettes each having a rigid mouthpiece at one end.

Figure 2:
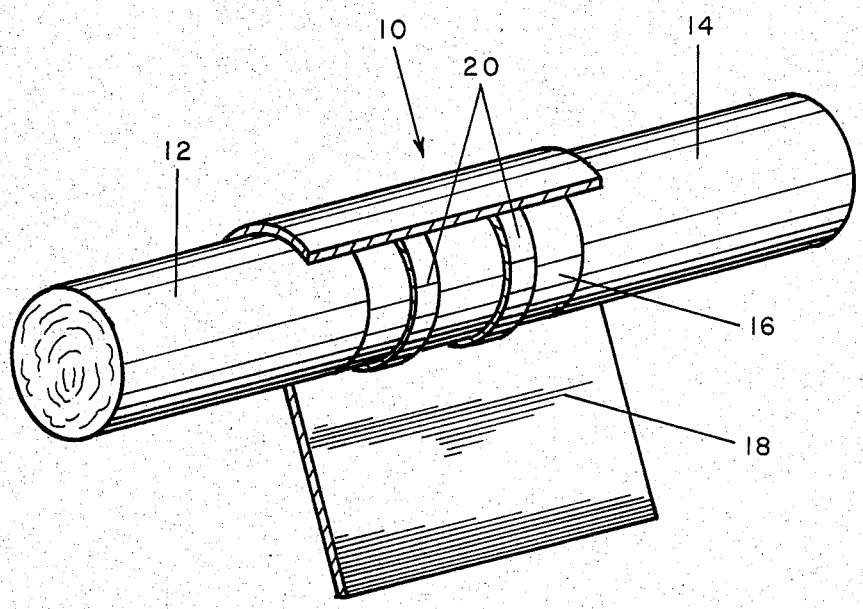
FIG. 2 is another version of a cigarette group produced by the present invention with the tipping material partially unwrapped to more clearly show details.

In order to assure that the tipping material 18 adheres to the rigid mouthpiece, a paper ring 20 is optionally wrapped about the mouthpiece underlaying the tipping material, as can best be seen in FIG. 2, wherein the tipping material 18 is partially unwound to more clearly show details. In the above discussed manufacturing process, it is necessary to wrap two paper rings 20 about the double length mouthpiece 16 spaced apart from each other longitudinally of the double length mouthpiece 16 to opposite sides of the transverse centerline of the double length mouthpiece 16.

Figure 3:
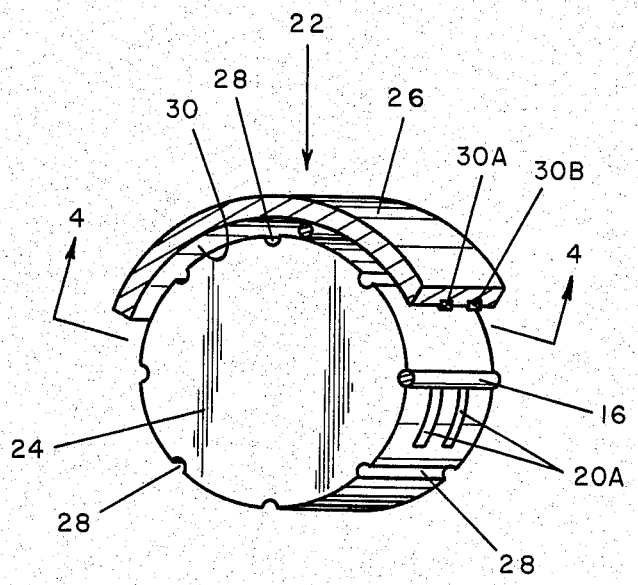
FIG. 3 is a perspective view of an apparatus embodying the present invention for wrapping two spaced apart rings around the perimeter of a double length mouthpiece spaced apart to opposite sides of the transverse centerline of the double length mouthpiece.

FIG. 3 illustrates an apparatus, generally denoted as the numeral 22 for winding the two rings 20 around the double length mouthpiece 16. The apparatus 22 consists of a rotatably mounted double length mouthpiece feed drum 24 and a stationary ring wrapping block 26 located in adjacent, spaced relationship to an arcuate portion of the periphery of the mouthpiece feed drum 24.

The mouthpiece feed drum 24 includes a plurality of open notches 28 formed in its' peripheral surface at substantially equally spaced intervals therearound. Each notch 28 is oriented with its longitudinal axis substantially parallel with the axes of rotation of the mouthpiece feed drum 24 and is adapted to receive therein a double length mouthpiece 16. Preferably, the mouthpiece feed drum 24 is at least as wide as the length of a double length mouthpiece 16, and the depth of each notch 28 is approximately ⅓ mouthpiece diameters so that a majority of the double length mouthpiece 16 remains outside of a notch 28. As depicted at the area "A" in FIG. 3, before a double length mouthpiece 16 is deposited in a mouthpiece receiving notch 28, two parallel, spaced apart strips 20A of paper, which will be wound about the double length mouthpiece 16 to form the rings 20, are deposited over the mouthpiece receiving notch 28 to either side of the transverse centerline of the notch 28. The strips 20A are each deposited with its leading edge over the notch 28 so that the leading edge of the strip 20A will be adhesively attached to the double length mouthpiece 16 to be received in the notch 28 with the rest of the strips 20A trailing out over the periphery of the mouthpiece feed drum 24 between adjacent notches 28 behind the double length mouthpiece 16 deposited in the notch 28 and to which its leading edge is attached.

Figure 4:
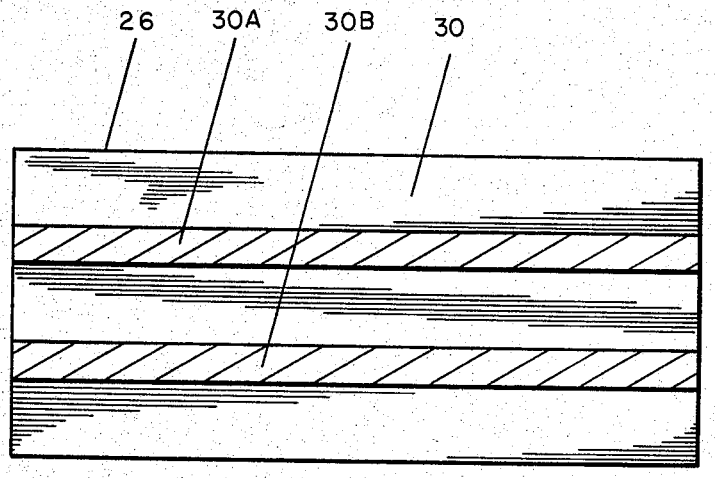
FIG. 4 is an enlarged bottom view of a stationary wrapping block of the present invention as viewed in the direction of arrows 4—4 in FIG. 3.

Referring to FIGS. 3 and 4, the stationary wrapping block 26 is formed with an arcuate surface 30 spaced from and concavely facing the peripheral surface of the mouthpiece feed drum 24. The curvature of the arcuate surface 30 of the wrapping block 26 corresponds to the curvature of the periphery of the mouthpiece feed drum 24 so that the space between them is uniform along the length of the wrapping block 26. The arcuate surface 30 of the wrapping block 26 includes two parallel, spaced apart elongated mouthpiece contact zones 30A and 30B equally located to either side of the longitudinal centerline of the arcuate surface 30 and extending substantially the full length of the arcuate surface 30. Further, each contact zones 30A and 30B is about as wide as the width of a paper strip 20A and is in alignment with a different one of the strips 20A. The distance between contact surfaces 30A and 30B and the peripheral surface of the drum 24 corresponds to the amount by which the double length mouthpiece projects out of the notches 28 beyond the periphery of the feed drum 24. The contact surfaces 30A and 30B are fabricated of a relatively soft, resilient material having a relatively high coefficient of rolling friction with the material of the double length mouthpiece, for example, on the order of at least 0.2. A suitable material is a low density foam rubber. One such material which has been successfully used is a product sold by Scholl, Inc. of Memphis, Tenn. under the trademark "MOLEFORM".

In operation, as the mouthpiece feed drum 24 rotates, it sequentially delivers double length mouthpieces 16 to the entrance or upstream end of the stationary rinf wrapping block 26. As the double length mouthpiece 16 enters the space between the wrapping block 26 and feed drum 24, the contact zones 30A and 30B contact the double length mouthpiece 16 in a notch 28 of the drum 24 causing the contacted double length mouthpiece 16 to roll counter to the rotation of the feed drum 24 and out of the notch 28 onto the peripheral surface of the drum 24. The double length mouthpiece 16 on the peripheral surface of the drum 24 remains in contact with the resilient zones 30A and 30B of the wrapping block 26 causing the double length mouthpiece 16 to roll counter to the rotational direction of the wrapping drum 24 on the peripheral surface of the drum 24 between adjacent notches 28 thereby wrapping each of the strips 20A around the perimeter of the double length mouthpiece 16 forming the two spaced apart rings 20 around the double length mouthpiece 16 spaced apart from each other to opposite sides of the transverse centerline of the double length mouthpiece 16.

Figure 5:
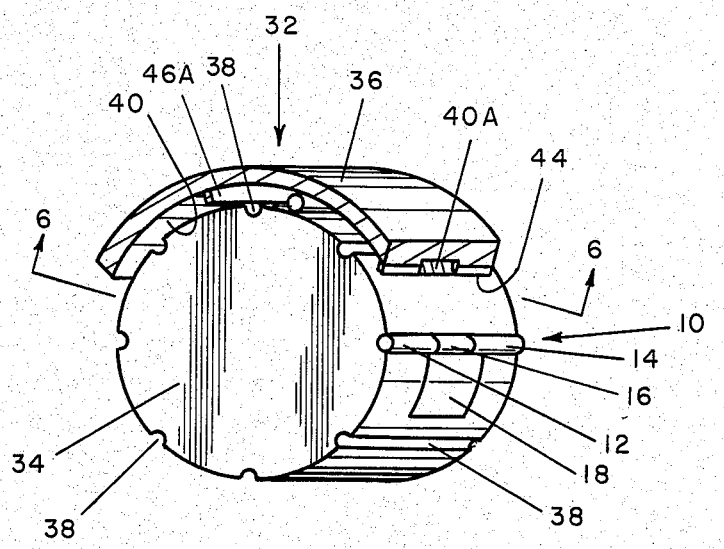
FIG. 5 is a perspective view of an apparatus embodying the present invention for attaching two cylindrical tobacco columns to an intermediately disposed double length rigid mouthpiece; and, FIG. 6 is an enlarged bottom view of a stationary rolling block of the present invention as viewed in the direction of arrows 6—6 in FIG. 5.

Now with reference to FIG. 5, there is shown an apparatus generally denoted as the number 32, for attaching the two axially aligned tobacco columns 12 and 14 to the intermediately disposed double length mouthpiece 16 by wrapping the sheet of tipping material 18 around the mouthpiece 16 and a portion of each tobacco column immediately adjacent to each end of the double length mouthpiece 16. The apparatus 32 consists of a rotatably mounted cigarette group feed drum 34 and a stationary rolling block 36 located in adjacent, spaced relationship to an arcuate portion of the periphery of the feed drum 34.

The feed drum 34 includes a plurality of open notches 38 formed in its' peripheral surface at substantially equally spaced apart intervals therearound. Each notch 38 is oriented with its longitudinal axis substantially parallel with the axis of rotation of the feed drum 34 and is adapted to receive therein a cigarette group 10. Preferably, the cigarette group feed drum is at least as wide as the length of a cigarette group 10, and the depth of each notch is approximately $\frac{1}{3}$ tobacco column diameters so that a majority of the cigarette group 10 remains outside of the notch 38. As depicted at area "A" in FIG. 5, before a cigarette group 10 is received in a notch 38, a sheet of tipping material 18 is deposited over the notch 38 so that the leading edge of the sheet of tipping material 18 will be adhesively attached to the double length mouthpiece 16 and end portions of the tobacco columns 12 and 14 to be received in the notch 38 with the rest of the tipping material trailing out over the periphery of the feed drum 34 between adjacent notches 38 behind the cigarette group 10 to which it is attached.

Figure 6:
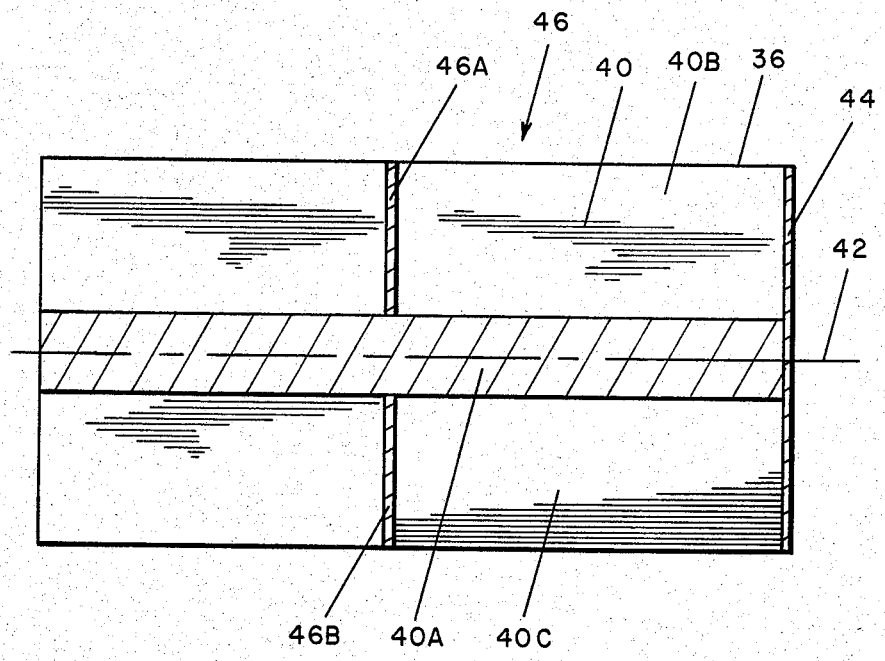

Referring to FIGS. 5 and 6, the stationary rolling block 36 is formed with an arcuate cigarette group contact surface 40 spaced from and concavely facing the peripheral surface of the feed drum 34. The rolling block 36 is located downstream of the location whereat the cigarette group 10 is deposited in the notches 38. The curvature of the arcuate surface 40 corresponds to the curvature of the periphery of the feed drum 34 so that the space between them is uniform along the length of the rolling block 36. The space between the contact surface 40 of the rolling block 36 and peripheral surface of the feed drum 34 is smaller than the diameter of the cigarette group 10. The overall width of the contact surface 40 is generally equal to the width of the feed drum 34 and is divided into three longitudinally extending contact zones, a middle zone 40A straddled by two virtually identical side zones 40B and 40C. The width "W" of the middle zone 40A is substantially equal to the width of the tipping material 18, with the longitudinal centerline 42 of the middle contact zone 40A being in-line with the transverse centerline of the double length rigid mouthpiece of a cigarette group 10 carried by the notches 38 so that the middle contact zone 40A makes contact only with the double length rigid mouthpiece 16 and a small portion of each tobacco column 12 and 14 immediately adjacent to the ends of the mouthpiece 16 about which the tipping material 18 is to be rolled as the feed drum moves a cigarette group 10 beneath the rolling block 36. Each of the side zones 40B and 40C contacts a different one of the tobacco columns 12 and 14 extending from the opposite ends of the double length mouthpiece 16 contacted by the middle zone 40A. The middle contact zone 40A and side contact zones 40B and 40C are mutually coextensive. The middle contact zone 40A is fabricated of a relatively soft, resilient material having a relatively high coefficient of rolling friction on the order of 0.2 or higher, such as for example, a low density foam rubber, and the like. A suitable commercially available material has been found to be a product sold by Scholl, Inc. of Memphis, Tenn. under the trademark "MOLEFORM". The side contact zones 40B and 40C are, preferably, a polished metal.

The rolling block 36 also can include at least one breaker bar 44 at the entering end of the rolling block 36. The breaker bar 44 is generally as long as the combined lengths of the tobacco columns 12 and 14 and intermediate double length mouthpiece 16 of the cigarette group 10, and is substantially parallel to the cigarette group 10 in a notch 38 passing beneath it. In addition, breaker bar 44 projects toward the peripheral surface of the feed drum 34 beyond the arcuate contact surface 40 of the rolling block 36. As can be best seen in FIG. 5, if the distance between adjacent notches 38 of the drum 34 is less than the length of the arcuate contact surface 40, it may be desirable to provide at least a second breaker bar, generally denoted as the number 46 projecting toward the peripheral surface of the drum 34, parallel to the breaker bar 44 and spaced therefrom by a distance generally corresponding to the distance between adjacent notches 38. The second breaker bar 46 is illustrated in FIG. 6 as consisting of two longitudinally aligned breaker bar halves 46A and 46B. As shown, the breaker bar half 46A projects from the side contact zone and the other breaker bar half 46B projects from the other side contact zone 40C toward the peripheral surface of the drum 34.

In operation, as the feed drum 34 rotates, it sequentially delivers cigarette group 10 to the entrance or upstream end of the rolling block 36. As a cigarette group 10 enters the space between the rolling block 36 and feed drum 34, the breaker bar 44 engages the entire length of the cigarette group 10 disposed in the notch 38 passing beneath it interfering with the movement of the engaged cigarette group 10 with the feed drum 34 causing the engaged cigarette group 10 to roll counter to the rotation of the feed drum and out of the notch 38 onto the peripheral surface of the drum 34. Immediately after passing beneath the breaker bar 44, the double length mouthpiece 16 of the cigarette group 10 on the peripheral surface of the drum 34 is contacted by the resilient middle contact zone 40A of the rolling block contact surface and the two tobacco columns 12 and 14 extending from opposite ends of the double length mouthpiece 16 are contacted by different ones of the side contact zones 40B and 40C causing the cigarette group 10 to roll counter to the rotational direction of the drum 34 on the peripheral surface of the drum 34 between adjacent notches 38 thereby wrapping the tipping material 18 around the double length mouthpiece 16 and end portions of the tobacco columns 12 and 14 adjacent to the opposite ends of the double length mouthpiece 16 before the cigarette group 10 drops into the next succeeding notch 38. It sometimes is preferable to re-roll the cigarette group 10 at least once after the tipping material 18 has been initially wrapped around the cigarette group to assure proper adhesion of the tipping material to the tobacco columns and mouthpiece. Toward this end, the rolling block 36 is longer than the circumference of the cigarette group 10 so that the cigarette group will make more than one revolution, for example, two and one-half revolutions beneath the rolling block 36. In this situation, the second breaker bar 46 is provided to engage just the tobacco columns 12 and 14. Each breaker bar half 46A and 46B of the second breaker bar 46 engages a different one of the tobacco columns 12 and 14 of the cigarette group 10 to either side of the intermediate rigid double length mouthpiece 16 to roll the cigarette group 10 out of the succeeding notch 38 and back onto the peripheral surface of the drum 34. With the cigarette group 10 again on the peripheral surface of the drum 34, the resilient middle contact zone 40A engages the tipping material around the rigid mouthpiece 16 and the side contact zones 40B and 40C engage different ones of the attached tobacco columns 12 and 14 causing the cigarette group 10 to again roll counter to the rotational direction of the drum on the peripheral surface between adjacent notches thereby re-rolling the tipping material 18 before the cigarette group 10 drops into the next succeeding notch 38. The rolling block 34 can be made to any desired length to cause the cigarette group 10 to be successively re-rolled any number of times. However, additional breaker bars similar to the second breaker bar 46 may have to be provided at intervals therealong generally corresponding to the distance between adjacent notches 38 in the feed drum 34 to cause the cigarette groups to roll out of the notches 38 and onto the peripheral surface of the drum 34.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A device for applying two paper rings around the circumference of a double length cigarette mouthpiece spaced apart from each other to opposite longitudinal sides of the transverse centerline of the double length mouthpiece, comprising:

a rotatable drum at least as wide as the length of a double length mouthpiece, the rotatable drum having a plurality of double length mouthpiece receiving notches formed in its periphery at spaced apart intervals therearound, the notches being oriented with their longitudinal axes substantially parallel to the axis of rotation of the drum; and, a stationary wrapping block having an arcuate contact surface concavely facing the periphery of the drum, the arcuate contact surface of the wrapping block corresponding to the curvature of the peripheral surface of the drum and being spaced from the peripheral surface of the drum by a preselected distance less than the diameter of the double length mouthpiece, and two spaced apart contact zones spaced apart to opposite sides of the longitudinal centerline of the wrapping block adapted to contact longitudinally spaced apart portions of the double length mouthpiece, the contact zones being of a relatively soft, resilient material having a relatively high coefficient of friction with the mouthpiece.

2. The device of claim 1, wherein the arcuate contact surface of the wrapping block is longer than the distance between adjacent double length mouthpiece receiving notches of the drum.

3. The device of claim 1, wherein the notches formed in the drum have a depth of less than the diameter of a double length mouthpiece so that a majority of the double length mouthpiece remains outside of the notch.

4. The device of claim 1, wherein the soft, resilient material of the contact zones has a coefficient of rolling friction with a double length mouthpiece of at least 0.2.

5. A device for attaching two cylindrical tobacco columns to an intermediately disposed double length, rigid mouthpiece by wrapping a sheet of tipping material around the double length rigid mouthpiece and a portion of each tobacco column immediately adjacent to each end of the double length mouthpiece to form a cigarette group, comprising:

a rotatable drum at least as wide as the combined lengths of the two tobacco columns and intermediate double length, rigid mouthpiece, the rotatable drum having a plurality of cigarette group receiving notches formed in its periphery at spaced apart intervals therearound, the notches being oriented with their longitudinal axes substantially parallel to the axis of rotattion of the drum; and, a stationary rolling block having an arcuate contact surface concavely facing the periphery of the drum, the arcuate contact surface of the rolling block corresponding to the curvature of the peripheral surface of the drum and being spaced from the peripheral surface of the drum by a preselected distance less than the diameter of the double length mouthpiece, at least the middle zone of the contact surface being adapted to contact the intermediately disposed double length rigid mouthpiece of the cigarette group on the peripheral surface of the drum between adjacent notches formed in the drum being of a relatively soft, resilient material having a relatively high coefficient of friction with the mouthpiece.

6. The device of claim 5, wherein the rolling block further comprises two side contact surfaces straddling the middle contact surface, and each of the side contact surfaces being adapted to contact a different one of the tobacco columns of the cigarette group on the peripheral surface of the drum.

7. The device of claim 6, wherein the side contact surfaces are generally co-extensive with the middle contact surface.

8. The device of claim 6, wherein the side contact surfaces are fabricated of a relatively hard material and present a smooth surface to the tobacco columns.

9. The device of claim 8, wherein the side contact surfaces of the rolling block are polished metal.

10. The device of claim 5, further comprising means for causing the cigarette groups to roll out of the notches of the drum and onto the peripheral surface of the drum as the cigarette groups enter the space defined between the arcuate contact surface and periphery of the drum.

11. The device of claim 10, wherein the means for causing the cigarette groups to roll out of the notches and onto the periphery of the drum comprises a breaker bar at the entering end of the rolling block, the breaker bar being generally as long as the combined lengths of the two tobacco columns and intermediate double length rigid mouthpiece of the cigarette group, the breaker bar being substantially parallel to the longitudinal axes of the notches in the rotatable drum and projecting from the arcuate surface of the rolling block toward the peripheral surface of the drum to contact the cigarette group passing beneath the breaker bar to roll the cigarette group out of the notch and onto the peripheral surface of the drum between adjacent notches.

12. The device of claim 5, wherein the arcuate contact surface of the rolling block is longer than the distance between adjacent cigarette groups receiving notches of the drum so that the cigarette group will make more than one revolution as it passes beneath the arcuate contact surface of the rolling block.

13. The device of claim 12, further comprising:

first means for causing the cigarette groups to roll out of the notches of the drum and onto the peripheral surface of the drum as the cigarette group enters the space between the arcuate contact surface and periphery of the drum; and, second means spaced along the arcuate contact surface from the first means by a distance generally corresponding to the distance between adjacent notches for causing the cigarette groups to roll out of the notches of the drum and onto the peripheral surface of the drum.

14. The device of claim 13, wherein:

the first means for rolling cigarette groups out of a notch comprises a first breaker bar at the entering end of the rolling block, the breaker bar being generally as long as the combined lengths of the two tobacco columns and intermediate double length mouthpiece of the cigarette group, the breaker bar being substantially parallel to the longitudinal axes of the notches in the rotatable drum and projects from the arcuate surface of the rolling block toward the peripheral surface of the drum to contact the tobacco columns and intermediate double length filter rod of a cigarette group in a notch of the drum as the cigarette group passes beneath the breaker bar to roll the cigarette group out of the notch and onto the peripheral surface of the drum between adjacent notches; and, the second means for rolling cigarette groups out of the notch comprises at least one second breaker bar spaced along the arcuate contact surface from the first breaker bar by a distance generally corresponding to the distance between adjacent cigarette groups receiving notches of the drum, the second breaker bar including two longitudinally aligned breaker bar halves projecting from the arcuate surface of the rolling block from either side of the middle of contact zone toward the peripheral surface of the drum to contact only the two tobacco columns of the cigarette groups passing beneath the second breaker bar to roll the cigarette groups out of the notch and onto the peripheral surface of the drum between adjacent notches.

15. The device of claim 5, wherein the notches formed in the drum have a depth of less than the diameter of a cigarette group so that a majority of the cigarette group remains outside of the notches.

16. The device of claim 5, wherein the soft, resilient material of the middle contact zone has a coefficient of rolling friction with the double length mouthpiece of at least 0.2.

* * * * *